US005092808A

United States Patent [19]

Takasaka et al.

[11] Patent Number: 5,092,808

[45] Date of Patent: Mar. 3, 1992

[54] AIR ACTION TOY SYSTEM

[75] Inventors: Akira Takasaka, Yashio; Eiji Takuma, Kanagawa; Hirotsugu Tomizawa, Tokyo, all of Japan

[73] Assignee: Sega Enterprises, Ltd., Tokyo, Japan

[21] Appl. No.: 673,236

[22] Filed: Mar. 20, 1991

[30] Foreign Application Priority Data

Apr. 10, 1990 [JP] Japan ..... 2-38290[U]
Aug. 10, 1990 [JP] Japan ..... 2-84859[U]

[51] Int. Cl.[5] ..... A63H 33/40; A63H 29/16

[52] U.S. Cl. ..... 446/178; 446/179; 446/89

[58] Field of Search ..... 446/178, 176, 179, 180, 446/186, 190-192, 232, 423, 217; 434/126; 239/211, 289, 446, 443

[56] References Cited

U.S. PATENT DOCUMENTS

| | | | |
|---|---|---|---|
| 1,916,888 | 7/1933 | Pieschke | 446/180 X |
| 3,363,340 | 1/1968 | McKinley | 434/126 |
| 3,789,540 | 2/1974 | Convertine et al. | 446/180 |
| 4,250,657 | 2/1981 | Barlow et al. | 446/178 |

FOREIGN PATENT DOCUMENTS

| | | | |
|---|---|---|---|
| 2838610 | 2/1972 | Fed. Rep. of Germany | 446/180 |

*Primary Examiner*—Mickey Yu
*Attorney, Agent, or Firm*—Price, Gess & Ubell

[57] ABSTRACT

There is disclosed an action toy system comprising a base, an air blower, and unit toys connected with holes formed in the surface of the base. The blower blows air into the unit toys through the base and the holes to cause the toys to perform action.

20 Claims, 6 Drawing Sheets

FIG.1

AIR ACTION TOY SYSTEM

BACKGROUND OF THE INVENTION

1. Field of the Invention

The present invention relates to an air action toy system having unit toys which are mounted on an air board and which are made to perform various action by forcing air under pressure into the unit toys.

2. Description of the Prior Art

The present applicant has already proposed a pneumatically driven toy system. In particular, this system has an air blower and a base incorporating an air duct. Toys are detachably mounted on the base and pneumatically actuated.

In this known toy system, the air blower acts only to blow air into the air duct in the base and so the blower is merely a power source. Also, it is impossible for the base itself to control the flow of air. Hence, the action of each individual toy cannot be controlled arbitrarily.

SUMMARY OF THE INVENTION

It is an object of the invention to provide an air action toy system comprising an air blower acting also as an amusing toy together with a base equipped with a control mechanism for controlling the action of each individual toy.

The above object is achieved by an air action toy system comprising: a base provided with a plurality of holes in its surface; a manually operated portion mounted on the surface of the base; an air blower for blowing an air stream into the holes through the base, the blower being installed on the base; unit toys which are capable of being connected with the holes in the base and which are made to perform action by forcing the air stream into the unit toys through the base and the holes; and a switching mechanism which opens and closes the air passage communicating with the holes inside the base and which interlocks with the manually operated portion to open or close the air passage.

The flow of air into the holes can be controlled by operating the operating portion which opens and closes the holes.

Also, the above object is achieved by a toy system in which unit toys can be connected with any desired one of the holes in the surface of the base and can receive air from inside the base through the holes. The unit toys have movable portions activated by the received air. There are further provided stopping means for stopping the action of the movable portions. The stopping means can comprise either switches for plugging up the holes or anchoring portions bearing against the movable portions to stop the action. Another means for stopping the action is to insert anchoring portions from outside the unit toys so as to bear against the movable portions, for stopping the action.

In another embodiment of the invention, discharge ports identical in shape with the holes in the base are formed to expel the air to the outside of the toys after the air activates the movable portions of the unit toys. The action toys can be connected with the ports.

In the above structure, the unit toys are connected with the holes in the base. The air blower blows an air stream into the base. When the manually operated portion is operated, the switching mechanism interlocking with the operated portion opens or closes each hole to adjust the flow of air into the hole. Thus, the flow of air admitted into the unit toy connected with each hole is adjusted. In this way, the speed of operation of each unit toy is adjusted.

The stopping means of the unit toys can cut off the flow of introduced air or can be caused to bear against the movable portions, whereby the action of each unit toy is stopped independent of the flow of air admitted into each hole with which a unit toy is connected.

The discharge port for expelling the air activating the movable portion of the unit toy is made identical in shape with the connecting holes in the base to make it possible to connect another unit toy with the discharge port. In consequence, the air stream can be reused.

Other objects and features of the invention will appear in the course of the description thereof which follows

BRIEF DESCRIPTION OF THE DRAWINGS

.

DETAILED DESCRIPTION OF THE PREFERRED EMBODIMENT

Figure 1:
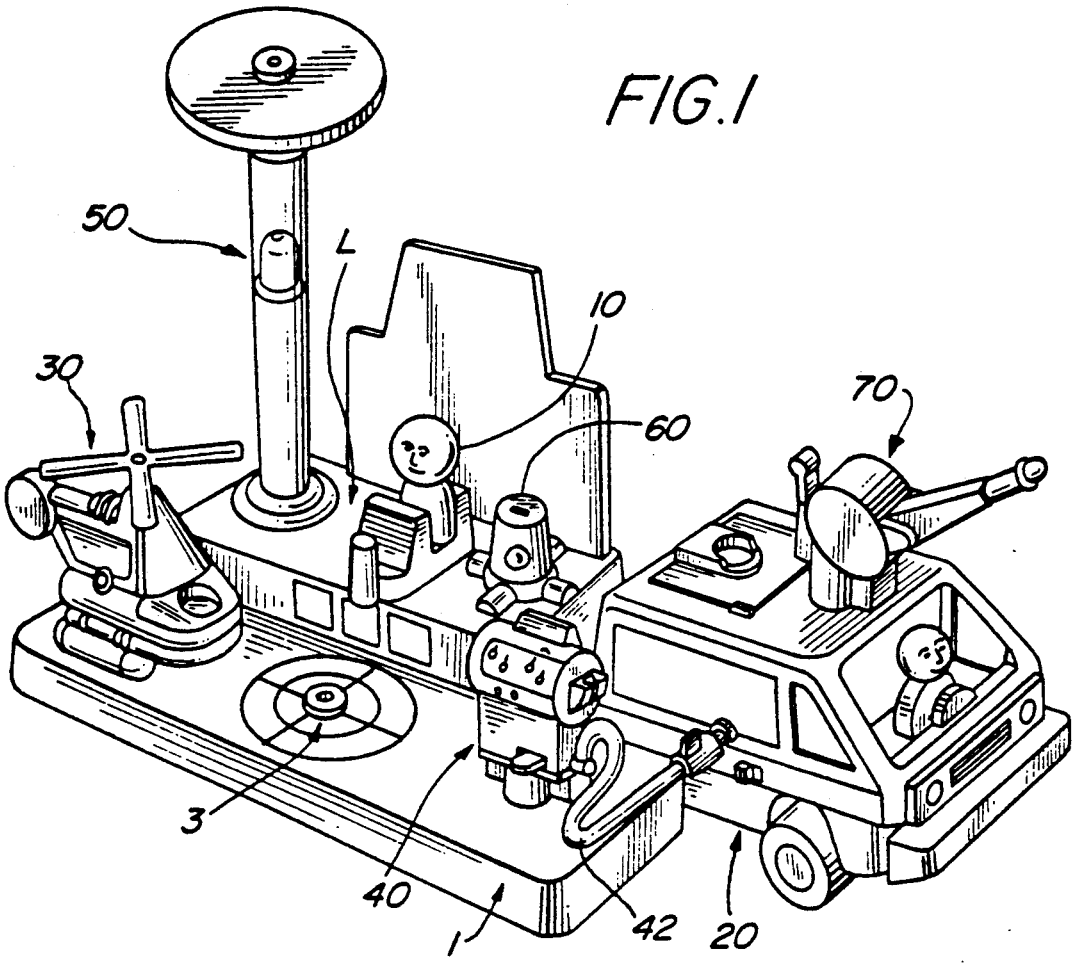
FIG. 1 is a perspective view of an air action toy system according to the invention.

Referring to FIG. 1, there is shown an air action toy system according to the invention. This system comprises a plastic base 1 and various unit toys including a toy car 20, a toy helicopter 30, a toy gasoline pump 40, a toy tower 50, a toy siren 60, and a toy water cannon 70.

Figure 2:
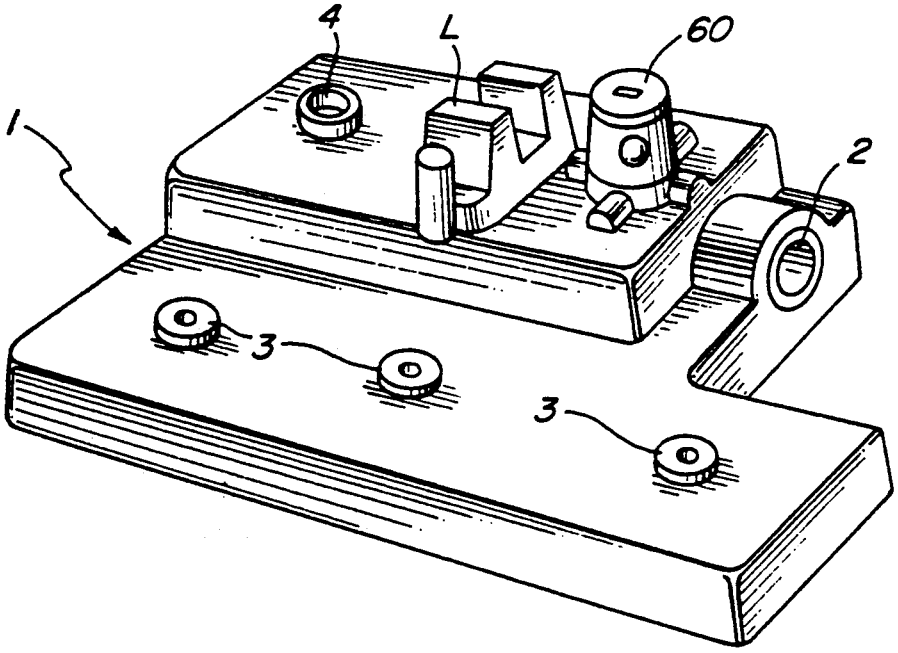
FIG. 2 is a perspective view of the base of the air action toy system shown in FIG. 1, and in which all the unit toys are removed.

Referring also to FIG. 2, the base 1 is generally rectangular in shape and has a cutout portion around the right rear corner as viewed in the figures. The base 1 has an elevated rear portion that is rectangular. A pipe 2 for introducing compressed air extends horizontally from the boundary of the cutout portion at the rear right side into the elevated rear portion of the base 1. The toy car 20 (FIG. 1) incorporating an air blower as described later is connected to the pipe 2. Three holes 3 reinforced with short cylindrical bosses 3 are formed in the front portion of the base 1. These holes 3 are located at the center, to the right, and to the left, respectively, in the front portion of the base 1. Another hole 4 reinforced with a short cylindrical boss is formed in the rear portion of the base 1 and located near the left end of the base 1. Action unit toys such as the helicopter 30 and the gasoline pump 40 are removably set in the holes 3. The tower 50 is removably set in the hole 4. A shutter-operating lever L is installed in the center of the rear portion of the base 1. The siren 60 is firmly mounted on the rear portion of the base 1 on the right side of the siren 60.

Figure 3:
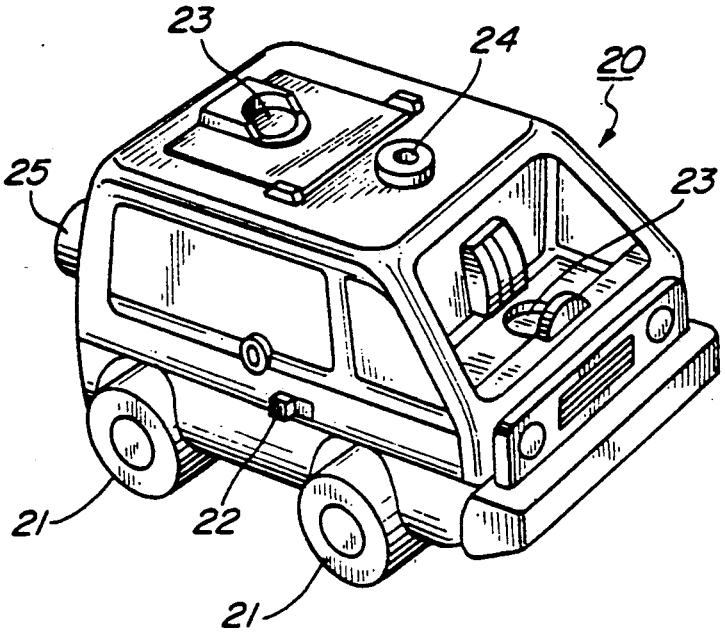
FIG. 3 is a perspective view of the toy car shown in FIG. 1, the toy car incorporating an air blower.

Referring next to FIG. 3, the toy car 20 containing the air blower takes the form of a van. The car 20 has front and rear tires 21 all of which are free to rotate. One can play with the car by pushing it by hand so as to move it. A power switch 22 for the air blower (described later) is attached to the rear side surface of the car. Cylindrical recesses 23 are formed in the driver's seat and in the center of the rear portion of the ceiling, respectively. Dolls can be withdrawably installed in the recesses 23. A hole 24 reinforced with a boss is formed in the center of the front portion of the ceiling. A connecting nozzle 25 protrudes rearward from the center of the rear surface of the car at a lower position in the rear surface.

Figure 4:
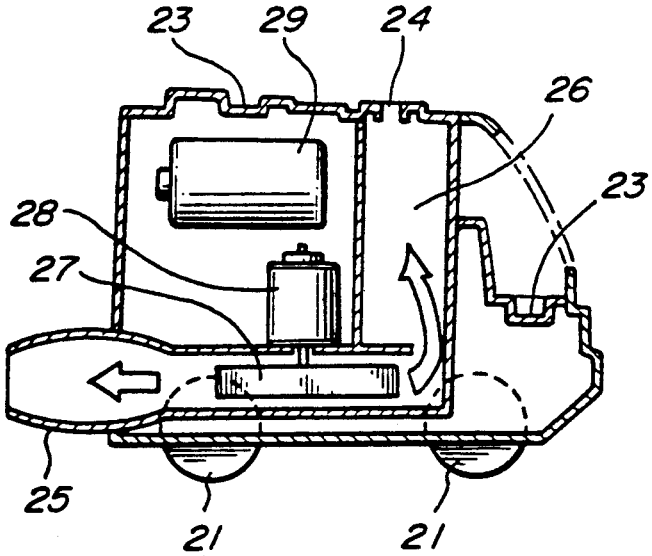
FIG. 4 is a cross-sectional view of the toy car shown in FIGS. 1 and 3.

The car 20 is shown in FIG. 4 in cross section. A duct 26 consists of a vertical portion located in the center of the car and a horizontal portion. The vertical portion is in communication with the front hole 24 in the ceiling. The horizontal portion is in communication with the connecting nozzle 25. The aforementioned air blower, indicated by numeral 27, is mounted in the lower horizontal portion of the duct 26 and pivotally mounted to the rotating shaft of an electric motor 28.

In order to operate the air blower 27, the power switch 22 is first closed. Then, electric power is supplied from a battery 29 installed in the car into the motor 28 to rotate the blower 27. Air flows into the blower 27 from the lower portion of the duct 26 and is forced into the rear connecting nozzle 25 and also toward the upper hole or port 24.

An action toy such as the water cannon 70 (FIG. 1) is removably installed in the hole 24. The helicopter 30 or the gasoline pump 40 can also be installed in the hole 24.

Figure 5:
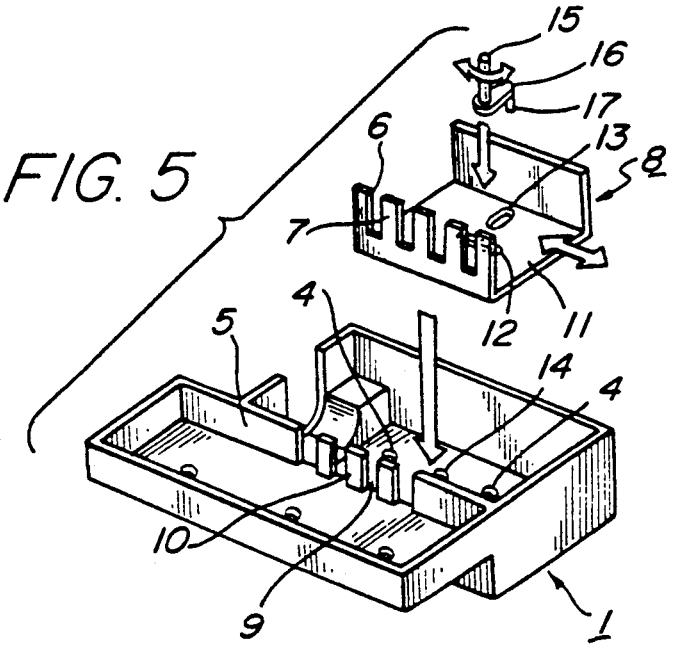
FIG. 5 is an exploded perspective view of the base shown in FIG. 1 and a shutter member, as viewed from the rear side of the base.

The internal structure of the base 1 is now described by referring to FIG. 5, which is an inverted exploded view of components in the base 1. The base 1 is partitioned into a front rectangular portion and a rear rectangular portion by an inner boundary wall 5. The portion of the wall 5 that is located under the shutter-operating lever L is provided with four vertical slits 9 which are identical in width. Vertical strips 10 are formed between the adjacent slits 9. Each slit 9 is narrower than each vertical strip 10. A shutter member 8 is so mounted that it can slide across the slits 9. The shutter member 8 is shaped like a staple. The height of the shutter member 8 is less than the internal height of the rear rectangular portion of the base 1. The shutter member 8 is narrower than the inside of the rear rectangular portion and can slide across the holes 4 in the base 1 and across the slits 9.

Figure 6:
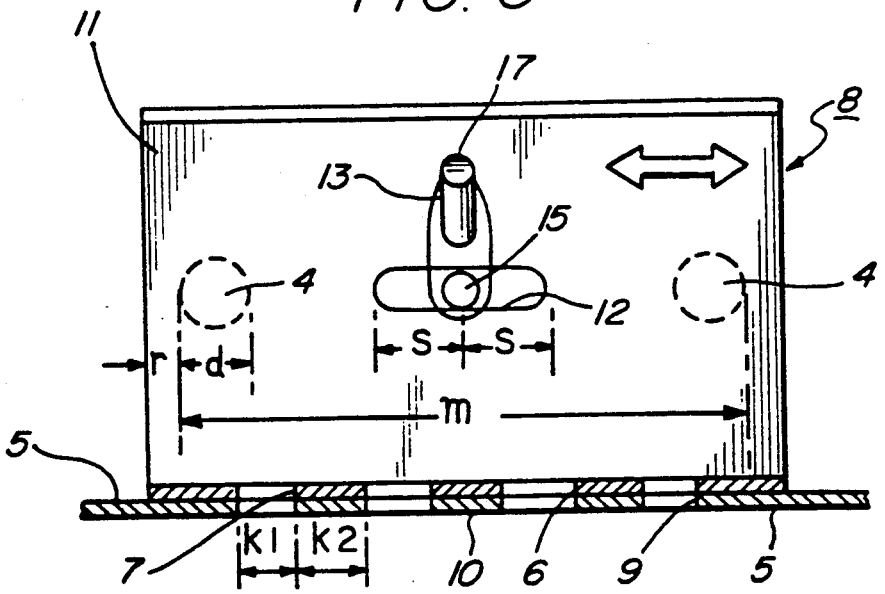
FIG. 6 is a plan view of the shutter member shown in FIG. 5.

FIG. 6 is a plan view of the shutter member 8. The length m of the shutter member 8 is equal to the length needed to just cover the hole 4 and another hole 4 lying immediately under the siren 60, plus $2\gamma$. One side of the shutter member 8 that slides along the slits 9 is provided with four slits 6 that are identical in width with the slits 9. Also, vertical strips 10 are identical in width with the vertical strips 7 forming parts of the inner boundary wall. A slot 12 is formed in the center of the bottom portion 11 of the shutter member 8. A vertically elongated hole 13 is formed behind the center of the slot 12.

Let k1 and k2 be the width of the slits and the width of the vertical strips, respectively. The width k1 is smaller than the width k2 but greater than $\gamma$. The width k2 of the vertical strips is greater than $(\gamma+d)$, where d is the diameter of the holes 4 in the tower and in the siren 60. Let 2s be the total length of the slot 12. The half length s is greater than the width k1 but smaller than the width k2.

When the shutter member 8 is so positioned that its slits 6 register with the slits 9 in the inner boundary wall 5 of the base 1, a circular hole 14 whose diameter is equal to the shorter width of the slot 12 is formed in the base at a position underlying the center of the slot 12. The surface of the base 1 forms a boss (not shown) to which the shutter-operating lever L is rotatably held. The lever L is connected with the shutter member 8 by a cam shaft 15.

Figure 7:
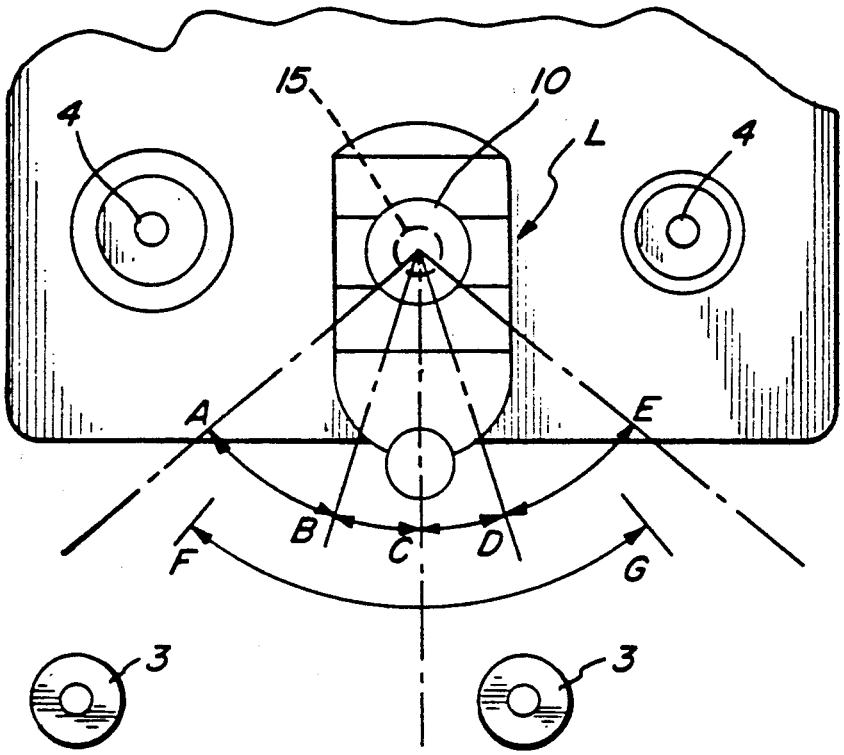
FIG. 7 is a plan view of the shutter-operating lever shown in FIG. 6, for showing the movement of the lever.

As shown in FIGS. 5 and 7, the cam shaft 15 extends through the circular hole 14 and is rigidly mounted to the underside of the shutter-operating lever L. A cam plate 16 is mounted over the cam shaft 15 inside the shutter member 8. A small protrusion 17. is formed on the cam plate 16 on the side of a slot 13 formed in the shutter member 8. As shown in FIG. 6, the protrusion 17 makes a sliding contact with the outer end of the fringe of the slot 13. The other end of the cam shaft 15 is rotatably supported to a boss (not shown) mounted on the floor plate of the base 1.

As described above, the shutter-operating lever L rotatably held on the surface of the base 1 is moved right or left to rotate the cam shaft 15 rigidly fixed to the lever L, as shown in FIG. 6. The protrusion 17 formed at the end of the cam shaft 16 that is mounted beside the shaft 15 makes a sliding contact with the fringe of the slot 13. As a result, the shutter member 8 is slided left or right.

The motion of the shutter-operating lever L is now described by referring to FIG. 7. When the lever L faces forward, the shutter member 8 is in its central position, i.e., the slits 6 are in registry with the slits 9. Under this condition, let C be the position of the lever. It is assumed that the lever can rotate through 50° either right or left. Let A and E be the maximum angular positions, respectively, of the lever. Let B and D be the positions of the lever which are spaced from the position C by about 15°. Let F and G be the positions spaced from the positions A and E, respectively, by 10° inside the positions A and E. The surface of the lever L which makes contact with the base is made convex at these positions A, C, and E. Alternatively, the surface of the base which makes contact with the lever L is made convex at these positions A, C, E. This permits the lever L to be locked at these positions.

Figure 8:
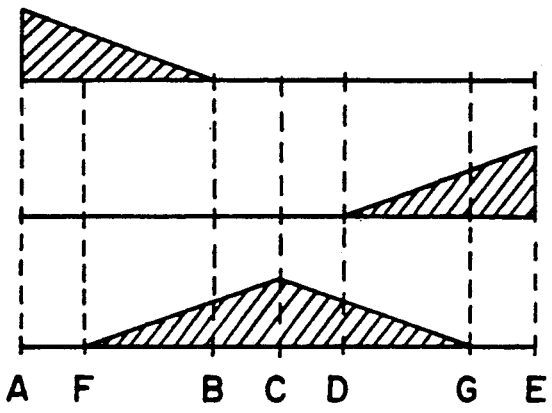
FIG. 8 is a diagram showing the degrees to which holes capable of being opened and closed by the shutter member shown in FIGS. 5 and 6 are opened.

The degrees to which the holes are opened by the sliding shutter member 8 are now described by referring to FIG. 8. When the lever L is in the position C, the slits 6 in the shutter member 8 completely register with the slits 9 in the inner boundary wall 5. In this state, the slits are opened fully.

When the lever L is placed in the position B, the protrusion 17 on the cam shaft slides the distance $\gamma$ away from the lever while retained in the slot 13 formed in the shutter member. The left end of the shutter member 8 is located in the leftmost position in the hole 4 formed in the tower 50. The area of the opened portions of the slits is slightly reduced.

When the lever L is rotated to the position F, the protrusion 17 on the cam shaft causes the shutter member 8 to slide the distance k1 while retained in the slot 13. In this state, the hole 4 in the tower 50 can be seen from the left end of the shutter member 8. The slits are fully closed.

When the lever is rotated to the left fully, the shutter member 8 slides the distance ($\gamma+d$). The hole 4 in the tower 50 is fully opened. The slits are kept closed, since the vertical strips are wider than the slits. Conversely, as the lever L is moved to the right, the slits are gradually closed, and the hole 4 in the siren 60 is opened to a larger extent.

As described thus far, the holes are opened or closed by the shutter member 8 according to the operation of the shutter-operating lever L. The flow of air admitted into the base by the toy car 20 including the air blower is controlled according to the degrees to which the holes are opened as shown in FIG. 8, the car being removably installed in the connecting hole 2.

Figure 9:
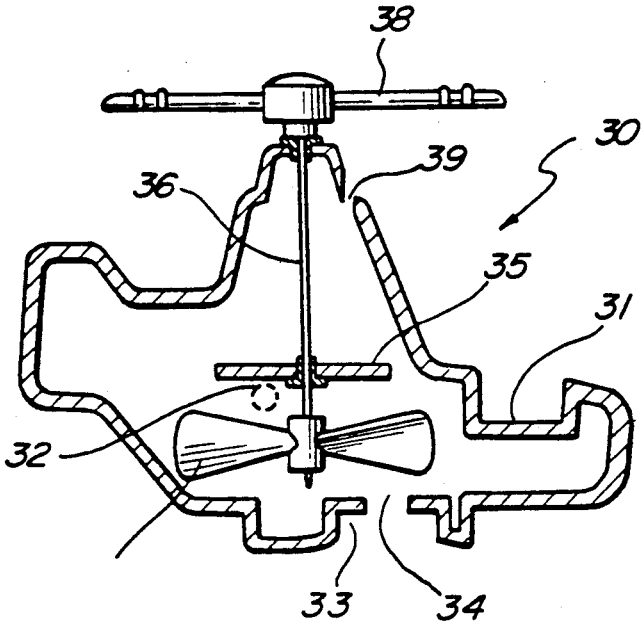
FIG. 9 is a vertical cross section of the toy helicopter shown in FIG. 1, for showing the internal structure of the helicopter.

The internal structure of the helicopter 30 is now described by referring to FIG. 9. The helicopter has a front doll mount portion 31 provided with a recess in which a doll is installed. The body of the helicopter 30 is provided with oil filler holes 32 at its opposite sides. A joint portion 33 in the form of a short cylinder is formed at the bottom and fits in the hole 3. The joint portion 33 is centrally provided with a circular hole 34. When the helicopter 30 is fitted in the hole 3, an air stream coming from inside the base is directed inwardly from the bottom inside the body and blown against a fan 37 pivotally mounted to a rotating shaft 36 inside the body. The shaft 36 is held to the top portion of the body in a vertical relation to an intermediate plate 35 that is mounted inside the body. The shaft 36 is rotated by the air to rotate a rotary wing or blade 38 pivotally mounted to the shaft 36 at the top of the body.

The gasoline pump 40 has an oil delivery hose 42 (FIG. 1) which can be inserted into any one of the oil filler holes 32 that face the fan 37. The nozzle at the front end of the hose 42 bears against the fan 37 to stop the rotation of the fan 37.

Figure 10:
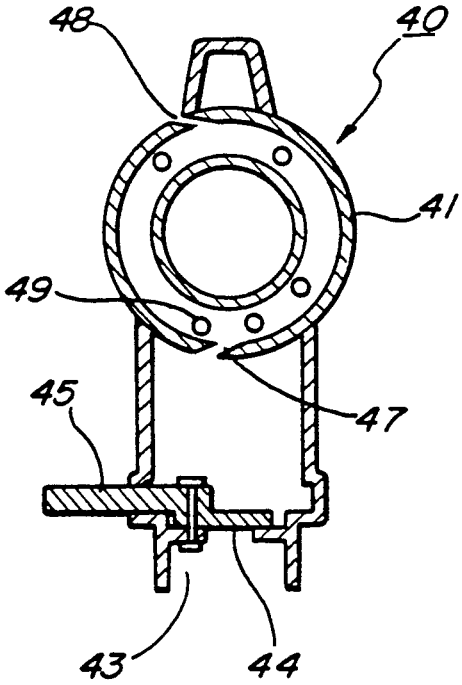
FIG. 10 is a vertical cross section of the gasoline pump shown in FIG. 1.

The internal structure of the gasoline pump 40 is shown in FIG. 10. The pump 40 comprises a rectangular stand and a transparent external cylindrical drum 41 mounted horizontally on the stand. The drum 41 is equipped with an ornament. The oil filler hose 42 extends outwardly from one side of the stand. The nozzle is attached to the front end of the hose. A joint portion 43 in the form of a short cylinder fitted in the hole 3 in the base 1 is formed at the bottom. When the joint portion 43 is fitted in the hole 3, air flows out of the base through an opening 44 formed in the joint portion 43.

A switching plate 45 which plugs up the opening 44 in the joint portion 43 is rotatably held to a shaft extending upright from the bottom wall of the stand. The plate 45 can slide on the bottom wall. When the plate 45 is slided to open the opening 44, air flows into the pump 40. When the plate 45 is so slided as to close the opening, no air can enter the pump.

An inside drum 46 having a smaller diameter than that of the outside drum 41 is mounted inside the outside drum 41 in a coaxial relationship to it. A slit 47 extending horizontally rearwardly is formed at the bottom of the outside drum 41 which is in contact with the top of the stand. A plurality of air escape slits 48 are formed in front upper portions of the outside drum 41. Foamed balls 49 having different colors are inserted between the outside drum 41 and the inside drum 46. The diameter of each ball 49 is greater than the diameters of the slits 47 and 48 but smaller than the space between the drums 41 and 46.

Thus, the air flowing in through the opening 44 in the joint portion 43 is ejected into the outside drum 41 rearwardly through the slit 47 at the bottom of the drum 41. This flings up the balls 49 rearwardly. Then, the balls 49 are forced along the inner surface of the outside drum 41 into the top front portion in the outside drum. Here, the air flows out of the drum through the escape slits 48, but the balls 49 cannot pass through these slits, because the balls are larger than the slits 47 and 48. The balls then drop forwardly and are again flung up by the air pouring in through the slit 47, so that the balls are rotated along the inner surface of the outside drum 41.

Since the outside drum 41 is transparent, the movement of the balls 49 can be seen from outside the drum. Because the balls 49 have various colors, their movement is very splendid and, therefore, one who sees this gasoline pump feels as if the instruments on the pump were operating.

Figure 11:
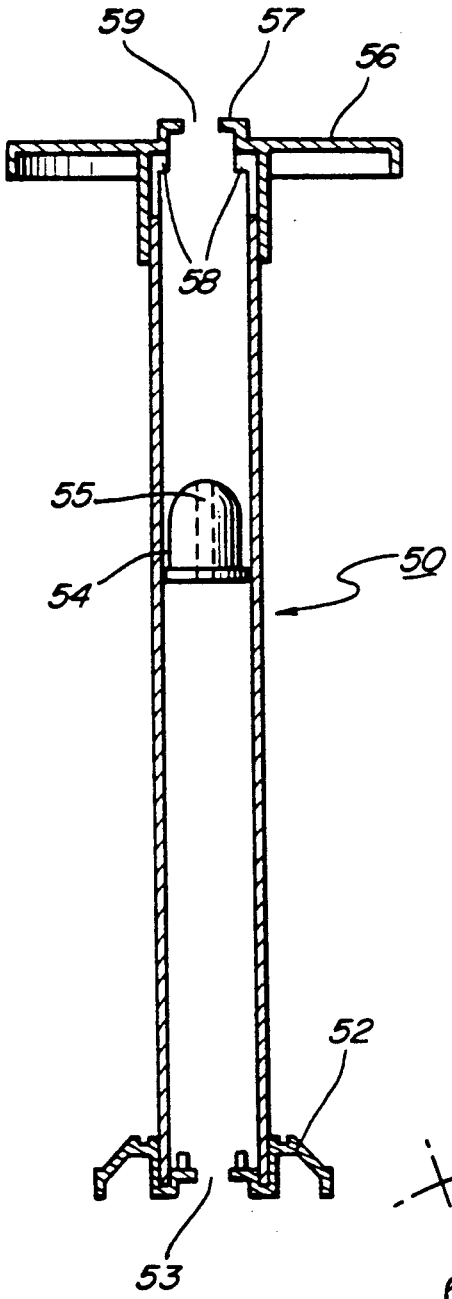
FIG. 11 is a cross-sectional view of the toy tower shown in FIG. 1.

The tower 50 is shown in FIG. 11 in cross section. The tower 50 comprises a long transparent cylinder 51 and a circular pedestal 52 rigidly fixed to the lower end of the cylinder 51. The pedestal 52 is so shaped as to fit in the hole 4 in the base. The pedestal 52 is centrally formed with an opening 53 having a diameter less than the inside diameter of the cylinder 51. A disk having a diameter slightly smaller than the inside diameter of the cylinder 51 is mounted inside the cylinder 51. A pillar whose diameter is slightly less than that of the disk and whose height is substantially the same as its diameter is mounted in the center of the upper surface of the disk. A domed elevator 54 is mounted on the pillar so as to be movable up and down. The elevator 54 is centrally provided with a vertical hole 55 extending through it.

The air flowing in through the opening 53 pushes up the disk supporting the elevator 54. The air flows upward along the inner surface of the cylinder around the outer periphery of the disk to push up the elevator 54. Since the hole 55 in the center of the elevator forms a bypass for the air flow, the speed of the elevator 54 is moderated.

A disklike member having a diameter larger than that of the pedestal 52 is rigidly fixed to the upper end of the cylinder 51. The central portion of the disklike member acts as a heliport 56 having a boss 57 that is the same as the boss located around the hole 4 in the base 1. The cylinder 51 is secured to the lower side of the boss 57 of the heliport 56. Radially and axially extending ribs 58 are formed on the inner wall of the cylinder on the back side of the boss 57. When the elevator 54 moves up, it is anchored by the ribs 58. When the dome of the elevator 54 bears on the ribs 58, the air passing around the elevator 54 can flow into the hole inside the boss of the heliport 56 after passing between the neighboring ribs 58.

If the helicopter 30 is installed on the boss 57 of the heliport 56, then the air flowing out through the opening 53 inside the boss 57 rotates the rotary wing 38 of the helicopter. At this time, if the amount of air flowing in through the hole inside the boss of the base is small, then it is impossible to push up the elevator 54. As a result, the elevator 54 will drop gradually by its own weight.

Figure 12:
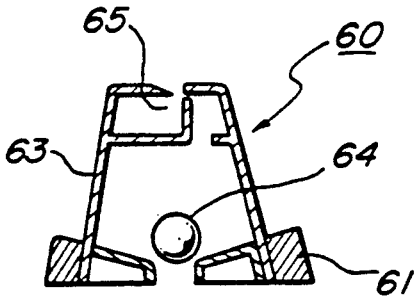
FIG. 12 is a cross-sectional view of the siren shown in FIG. 1.

The siren 60 is shown in FIG. 12 in cross section. The siren 60 comprises a pedestal 61 and a transparent conical base 63 mounted on the pedestal. The pedestal 61 is centrally provided with a round hole 62 in which the boss of the base is fitted. The upper surface of the pedestal 61 is inclined inward toward the hole 62. The inside of the conical base 61 is hollow and contains a single foamed ball 64 larger than the hole 62. A whistle mechanism 65 is formed at the top of the base 63. The air entering from the round hole 62 in the pedestal 61 raises the ball 64 wobbly over the hole 62. The manner in which the ball floats can be seen through the conical base 63, because it is transparent. The air then passes through the whistle mechanism 65 at the top of the siren and is discharged.

As the air flows through the whistle mechanism 65, it whistles. The moving ball 64 may plug up the round hole 62 and so the flow rate of air flowing into the whistle mechanism 65 varies constantly. Hence, the sound produced by this mechanism changes constantly and is heard as if it were emitted by a siren. The flow rate of the air can be varied more greatly by operating the shutter-operating lever L on the base 1.

Figure 13:
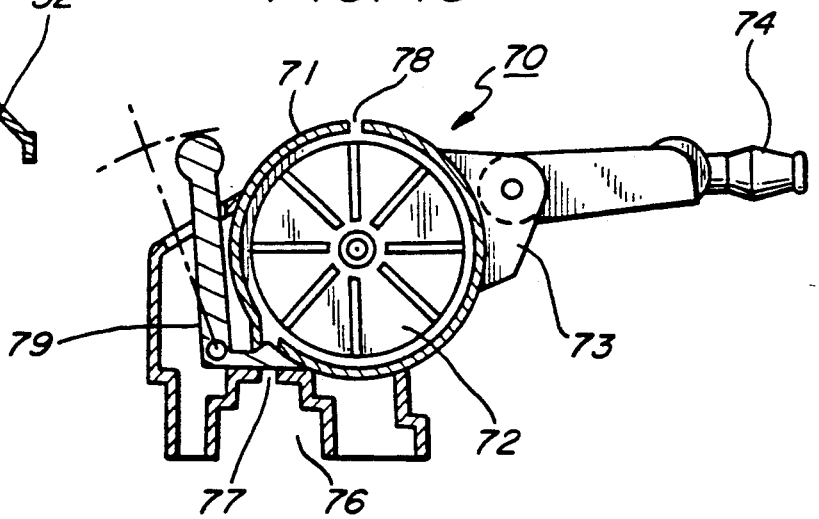
FIG. 13 is a cross-sectional view of the water cannon shown in FIG. 1.

The water cannon 70 is shown in FIG. 13 in cross section. The cannon comprises a transparent short cylinder 71 mounted horizontally, a vane wheel 72 rotatably mounted inside the cylinder 71, a retainer portion 73 formed on the front outer side of the cylinder 71, a nozzle 74 whose rear end is pivoted to the retainer portion 73 so that the front end of the nozzle can be moved up and down, a pedestal 75 mounted under the cylinder 71, and a joint portion 76 in which the corresponding boss is fitted. The joint portion 76 is mounted at the bottom of the pedestal 75. An opening 77 is formed in the center of the joint portion 76 and terminates in the upper cylinder 71. The air stream guided into the short cylinder 71 rotates the vane wheel 72 and is expelled through slits 78 formed in the top portion of the wall of the cylinder 71. An L-shaped switch member 79 is mounted inside the pedestal 75 on the rear side of the pedestal. The switch 79 consists of a horizontal portion capable of sliding in the pedestal 75 and a swinging portion pivoted to the sliding portion. When the swinging portion is thrown rearward, the horizontal portion bears against the outer periphery of the wheel 72, stopping its rotation.

As described thus far, the joint portions of the unit toys are common in structure. Therefore, any one of the helicopter 30, the gasoline pump 40, and the water cannon 70 can be removably connected to the boss over the hole 3. Also, the helicopter 30, the gasoline pump 40, and the cannon 70 can be withdrawably connected to the boss over the hole 57 of the heliport of the tower 50 and on the boss over the hole 24 in the toy car 20.

The novel air action toy system can control and distribute the air introduced by the toy car which is installed on the base and contains the air blower. Each individual toy is provided with an action stopping means. This permits the action of each individual toy to be controlled in playing with the toy system. One toy unit can be connected with the air discharge port of another toy unit, i.e., two unit toys can be connected together. Consequently, one can play with the air action toy system much more interestingly than conventional.

What is claimed is:

1. An air action toy system comprising:

a base provided with a plurality of holes in its surface;

an air blower, having an exhaust port for blowing an air stream through the base, removably connected to one of the holes, the air blower having a housing configured as a toy capable of independent play action by a child when removed from the base; and individual unit toys which are capable of being connected with the remaining holes in the base and which can be caused to perform play action by forcing the air stream into the unit toys from the base.

2. An air action toy system comprising:

a base provided with a plurality of holes in its surface;

a single manually operated member mounted on the surface of the base;

an air blower for blowing an air stream through the base, the blower being removably installed on the base;

unit toys which are capable of being connected with the holes in the base and which are caused to perform action by forcing the air stream into the unit toys out of the base;

a switching mechanism which opens and closes air passages communicating with the holes inside the base and which interlocks with the manually operated member to selectively open or close the air passages, for controlling and metering the flow of air admitted into the holes.

3. The air action toy system of claim 1, wherein said unit toys can be connected with any desired one of the holes in the surface of the base and receive air from inside the base through the holes, the unit toys having movable portions activated by the received air, and wherein there are further provided stopping means for stopping the action of the movable portions.

4. The air action toy system of claim 1, wherein said unit toys can be connected with any desired one of the holes in the surface of the base and receive air from inside the base through the holes, the unit toys having movable portions activated by the received air, and wherein there are further provided discharge ports for expelling the air to the outside of the unit toys after the air activates the movable portions, the discharge ports being identical in shape with the holes in the base.

5. The air action toy system of claim 2, wherein said unit toys can be connected with any desired one of the holes in the surface of the base and can receive air from inside the base through the hole, the unit toys having movable portions activated by the received air, and stopping means for stopping the action of the movable portions at a predetermined time.

6. The air action toy system of claim 2, wherein said unit toys can be connected with any desired one of the holes in the surface of the base and can receive air from inside the base through the hole, and wherein there are further provided discharge ports for expelling the air to the outside of the unit toys the discharge ports being identical in shape with the holes in the base.

7. The air action toy system of claim 1 wherein the air blower housing further includes rotatable wheels for transporting the housing across a support surface.

8. The action toy system of claim 7 wherein the air blower housing is configured to be a vehicle.

9. The air action toy system of claim 1 wherein the air blower housing includes a second port for emitting air that can be attached to a unit toy.

10. The air action toy system of claim 1 wherein the base is provided with a unitary switching mechanism that controls the airflow to each of the plurality of holes, including varying the amount of airflow between respective holes.

11. The air action toy system of claim 1 further including a unit toy configured to simulate of helicopter with a rotatable blade member.

12. The air action toy system of claim 1 further including a unit toy to simulate a metering gas pump.

13. The air action toy system of claim 10 wherein the unitary switch mechanism includes a U-shaped member having a series of slits on a wall and the base member includes an inner boundary wall with a complementary series of slits.

14. An air activated play set for children comprising:

a base member having a housing with a plurality of air discharge ports and one air input port;

an air blower unit having a housing simulating an independent toy capable of play action with a child, the air blower unit having a discharge port of a size for removable coaction with the air input port to provide a source of air pressure;

a plurality of unit toys, each having a play action feature activated by air pressure and an input port for removable coaction with the housing air discharge ports, and a switch mechanism mounted on the housing for controlling air pressure to the respective air discharge ports.

15. The air action toy system of claim 14 wherein the air blower housing further includes rotatable wheels for transporting the housing across a support surface.

16. The action toy system of claim 15 wherein the air blower housing is configured to be a vehicle.

17. The air action toy system of claim 16 wherein the air blower housing includes a second port for emitting air that can be attached to a unit toy.

18. The air action toy system of claim 16 further including a unit toy configured to simulate a helicopter with a rotatable blade member.

19. The air action toy system of claim 16 further including a unit toy to simulate a metering gas pump.

20. The air action toy system of claim 16 wherein the switch mechanism includes a U-shaped member having a series of slits on a wall and the base member includes an inner boundary wall with a complementary series of slits.

* * * * *